US009079079B2

(12) United States Patent
Fossum et al.

(10) Patent No.: US 9,079,079 B2
(45) Date of Patent: Jul. 14, 2015

(54) CLUB HEAD WITH DEFLECTION MECHANISM AND RELATED METHODS

(71) Applicants: Brandon L. Fossum, Phoenix, AZ (US); Michael R. Nicolette, Scottsdale, AZ (US); Bradley D. Schweigert, Anthem, AZ (US)

(72) Inventors: Brandon L. Fossum, Phoenix, AZ (US); Michael R. Nicolette, Scottsdale, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 242 days.

(21) Appl. No.: 13/797,772

(22) Filed: Mar. 12, 2013

(65) Prior Publication Data

US 2014/0080625 A1 Mar. 20, 2014

Related U.S. Application Data

(60) Provisional application No. 61/703,149, filed on Sep. 19, 2012.

(51) Int. Cl.

| | |
|---|---|
| ***A63B 53/04*** | (2006.01) |
| ***A63B 49/06*** | (2006.01) |
| *A63B 59/12* | (2006.01) |

(52) U.S. Cl.

CPC ..... *A63B 53/0466* (2013.01); *A63B 49/06* (2013.01); *A63B 53/047* (2013.01); *A63B 53/0487* (2013.01); *A63B 59/12* (2013.01); *A63B 2053/0433* (2013.01); *A63B 2053/0437* (2013.01); *A63B 2053/0491* (2013.01)

(58) Field of Classification Search

CPC ..... A63B 53/0466; A63B 2053/0433; A63B 2053/0437; A63B 49/06; A63B 53/047; A63B 53/0487; A63B 2053/0491

USPC ..... 473/324–350, 287–292, 409

See application file for complete search history.

(56) References Cited

U.S. PATENT DOCUMENTS

| | | | | |
|---|---|---|---|---|
| 5,380,009 | A | 1/1995 | Henry et al. | |
| D366,682 | S | 1/1996 | Antonious | |
| 5,632,695 | A | 5/1997 | Hlinka et al. | |
| 5,762,567 | A | 6/1998 | Antonious | |
| RE35,955 | E * | 11/1998 | Lu | 473/329 |
| 6,348,013 | B1 | 2/2002 | Kosmatka | |
| 6,530,847 | B1 | 3/2003 | Antonious | |
| 8,083,612 | B2 | 12/2011 | Stites et al. | |
| 8,235,841 | B2 * | 8/2012 | Stites et al. | 473/328 |
| 8,235,844 | B2 * | 8/2012 | Albertsen et al. | 473/345 |
| 8,403,771 | B1 * | 3/2013 | Rice et al. | 473/328 |
| 8,529,368 | B2 * | 9/2013 | Rice et al. | 473/329 |
| 8,591,351 | B2 * | 11/2013 | Albertsen et al. | 473/329 |
| 8,641,555 | B2 * | 2/2014 | Stites et al. | 473/328 |
| 8,721,471 | B2 * | 5/2014 | Albertsen et al. | 473/328 |
| 8,821,312 | B2 * | 9/2014 | Burnett et al. | 473/329 |
| 8,834,289 | B2 * | 9/2014 | de la Cruz et al. | 473/329 |

(Continued)

*Primary Examiner* — Sebastiano Passaniti

(57) ABSTRACT

A club head comprising a deflection mechanism located at an interface of a front portion and a body portion. The deflection mechanism is configured so that the front surface is able to deflect toward the body portion at a top end of the club head and about a bottom end of the club head. The deflection mechanism comprises a groove located between the front surface and the crown surface. The deflection mechanism comprises at least one deflection feature that is located in the groove and comprises a step portion and a riser portion. The step portion comprises a step portion first side and a step portion second side opposite the step portion first side. The riser portion comprises a riser portion first side and a riser portion second side opposite the riser portion first side.

15 Claims, 12 Drawing Sheets

(56) References Cited

U.S. PATENT DOCUMENTS

| | | | | |
|---|---|---|---|---|
| 8,834,290 | B2 * | 9/2014 | Bezilla et al. | 473/329 |
| 8,900,069 | B2 * | 12/2014 | Beach et al. | 473/329 |
| 2002/0183134 | A1 | 12/2002 | Allen et al. | |
| 2004/0192463 | A1 * | 9/2004 | Tsurumaki et al. | 473/329 |
| 2007/0021234 | A1 * | 1/2007 | Tsurumaki et al. | 473/329 |
| 2007/0026961 | A1 * | 2/2007 | Hou | 473/329 |
| 2011/0021284 | A1 * | 1/2011 | Stites et al. | 473/329 |
| 2012/0142447 | A1 | 6/2012 | Boyd et al. | |

* cited by examiner

CLUB HEAD WITH DEFLECTION MECHANISM AND RELATED METHODS

CROSS-REFERENCE TO RELATED APPLICATIONS

This application claims the benefit of U.S. Provisional Application No. 61/703,149, filed Sep. 19, 2012. U.S. Provisional Application No. 61/703,149 is incorporated herein by reference in its entirety.

TECHNICAL FIELD

This disclosure relates generally to sports equipment, and relates more particularly to club heads and related methods.

BACKGROUND

The launch angle and back spin applied to a golf ball struck by a golf club can impact the flight distance of the golf ball. The orientation of the strike face or strike plate of a golf club can impact the launch angle and back spin applied to a golf ball struck by the golf club. For example, the launch angle can be affected by the loft angle of the striking face or striking plate of the golf club. Further, the back spin can be applied to the golf ball through the gear effect of the strike face or strike plate. In general, increasing the launch angle and/or decreasing the back spin can increase the flight distance of the golf ball.

BRIEF DESCRIPTION OF THE DRAWINGS

To facilitate further description of the embodiments, the following drawings are provided in which.

Figure 1:
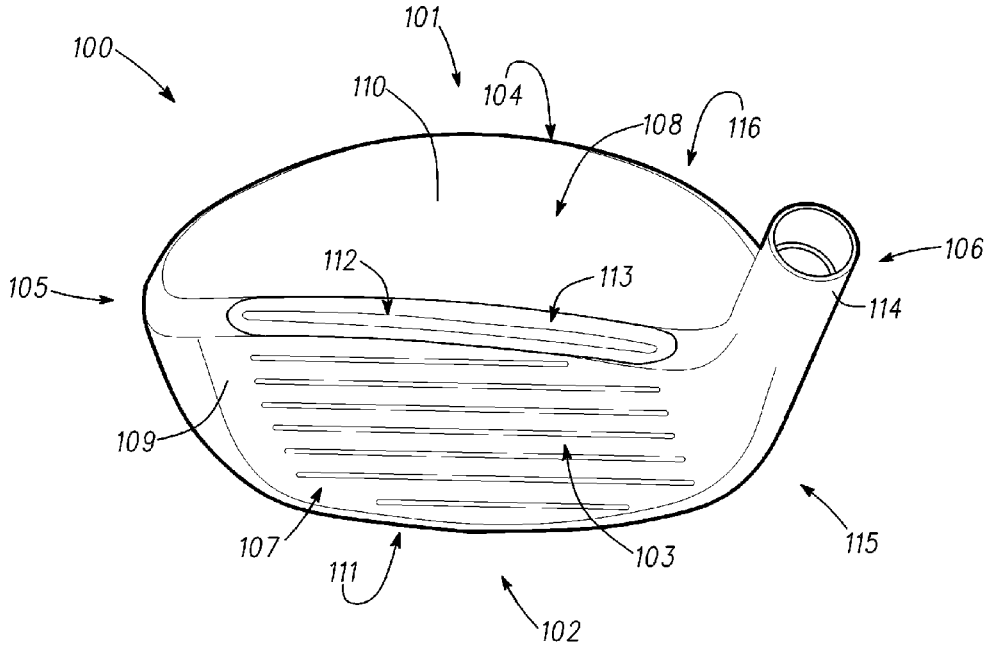
FIG. 1 illustrates a top view of an exemplary club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

Some embodiments include a club head. The club head comprises a top end and a bottom end opposite the top end.

Further, the club head comprises a front portion comprising a front surface. The front surface is associated with a face plane and a loft plane. Further still, the club head comprises a body portion comprising a crown surface and a sole surface. Meanwhile, the club head comprises a deflection mechanism located at an interface of the front portion and the body portion. The deflection mechanism is configured so that the front surface is able to deflect toward the body portion at one of the top end or the bottom end of the club head and about an other one of the top end or the bottom end of the club head.

Further embodiments include a method. The method comprises providing a club head. The club head comprises a top end and a bottom end opposite the top end. Further, the club head comprises a front portion comprising a front surface. The front surface is associated with a face plane and a loft plane. Further still, the club head comprises a body portion comprising a crown surface and a sole surface. Also, the method comprises providing a deflection mechanism located at an interface of the front portion and the body portion. The deflection mechanism is configured so that the front surface is able to deflect toward the body portion at one of the top end or the bottom end of the club head and about an other one of the top end or the bottom end of the club head.

Other embodiments include a method. The method comprises swinging a club head. The club head comprises a top end and a bottom end opposite the top end. Further, the club head comprises a front portion comprising a front surface. The front surface is associated with a face plane and a loft plane. Further still, the club head comprises a body portion comprising a crown surface and a sole surface. Meanwhile, the method comprises striking a golf ball at the front surface of the club head, where striking the golf ball at the front surface of the club head comprises deflecting the front surface toward the body portion at one of the top end or the bottom end of the club head and about an other one of the top end or the bottom end of the club head.

Still further embodiments include a golf club. The golf club comprises a club head and a club shaft coupled to the club head. The club head comprises a top end and a bottom end opposite the top end, a front portion comprising a front surface, a body portion, and a deflection mechanism located at an interface of the front portion and the body portion. The deflection mechanism can be configured such that striking a golf ball at the front surface of the club head causes the front surface to deflect toward the body portion at one of the top end or the bottom end of the club head and about an other one of the top end or the bottom end of the club head.

Turning to the drawings, FIG. 1 illustrates a top, front view of club head 100, according to an embodiment. Club head 100 is merely exemplary and is not limited to the embodiments presented herein. Club head 100 can be employed in many different embodiments or examples not specifically depicted or described herein.

Although club head 100 can comprise any suitable club head, in many examples, club head 100 comprises a wood-type golf club head (e.g., a driver club head, a fairway wood club head, a hybrid club head, etc.). In these or other examples, club head 100 can comprise a metal wood golf club head, but club head 100 also can comprise one or more other suitable materials. In particular, at least part of club head 100 can comprise stainless steel, titanium, titanium alloy, etc. In various embodiments, club head 100 can be hollow. Generally, club head 100 can be part of a golf club.

Figure 2:
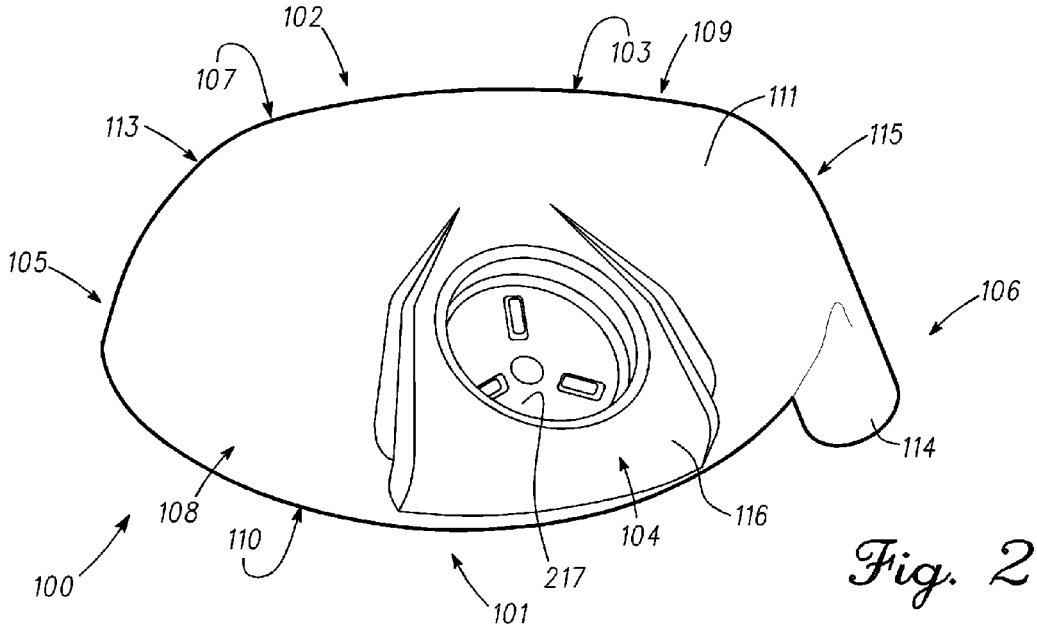
FIG. 2 illustrates a bottom, rear view of the club head of the embodiment of FIG. 1.

Club head 100 comprises top end 101, bottom end 102, front end 103, rear end 104, toe end 105, and heel end 106. Further, club head 100 comprises front portion 107, body portion 108, deflection mechanism 112, and interface 113. Club head 100 can comprise hosel 114, hosel transition portion 115, and/or one or more weight ports 217 (FIG. 2). In some embodiments, club head 100 can comprise skirt surface 116. Meanwhile, in other embodiments, hosel 114, hosel transition portion 115, skirt surface 116, and/or weight port(s) 217 (FIG. 2) can be omitted. Front portion 107 comprises front surface 109. Body portion 108 comprises crown surface 110 and sole surface 111, and can further comprise skirt surface 116. In some embodiments, sole surface 111 and/or skirt surface 116 can comprise weight port(s) 217 (FIG. 2).

Top end 101 is opposite bottom end 102; front end 103 is opposite rear end 104; and toe end 105 is opposite heel end 106. Rear portion 108 and/or skirt surface 116 can be at least partially opposite front portion 107; and/or crown surface 110 can be at least partially opposite sole surface 111. In many examples, skirt surface 116 can be located between at least part of crown surface 110 and at least part of sole surface 111. In these examples, skirt surface 116 can wrap around rear end 104 of club head 100 from toe end 105 to heel end 106.

Front portion 107 can be coupled and/or integral with body portion 108. Accordingly, front portion 107 can appear to merge with body portion 108 at interface 113, as described below. Further, crown surface 110, sole surface 111, and/or skirt surface 116 can also appear to merge together. Accordingly, one or more of front surface 109, crown surface 110, sole surface 111, and skirt surface 116 can appear to comprise a single surface. In some embodiments, one or more of the transitions between front surface 109, crown surface 110, sole surface 111, and skirt surface 116 can be curved and/or beveled (e.g., smooth), and in other embodiments, can be sharp and/or angled.

Interface 113 can refer to a line or region of transition between front portion 107 and body portion 108. When front portion 107 and body portion 108 are mechanically coupled together, interface 113 can be demarcated by the physical boundaries of front portion 107 and body portion 108 at which the two are mechanically coupled together. However, in many examples, front portion 107 and body portion 108 can comprise an integral body, such as, for example, when front portion 107 and body portion 108 are formed together. In these examples, interface 113 can demarcate a representative line or region at which front portion 107 transitions to body portion 108, and vice versa. In many examples, hosel 114 and/or hosel transition portion 115 can be part of body portion 108 to form part of interface 113.

Deflection mechanism 112 is located at (e.g., partially along) interface 113 of front portion 107 and body portion 108. More specifically, deflection mechanism 112 is located at one of top end 101 (as shown at FIG. 1) or bottom end 102 (not shown in FIG. 1) of club head 100 at interface 113. Deflection mechanism 112 can extend (e.g., continuously or discontinuously) between toe end 105 and heel end 106. Deflection mechanism 112 can extend for less than or equal to approximately a width of front surface 109. Deflection mechanism 112, which is described in greater detail below, is configured (a) so that front surface 109 is able to deflect toward body portion 108 at one of top end 101 or bottom end 102 and (b) so that front surface 109 is able to deflect about (i.e., rotationally) the other one of top end 101 or bottom end 102.

Front surface 109 can refer to a strike face and/or strike plate of club head 100, and can be configured to impact a golf ball (not shown). Front surface 109 can comprise one or more scoring lines (e.g., grooves). The scoring line(s) can extend between toe end 105 and heel end 106. When front surface 109 comprises multiple scoring lines, the scoring lines can be parallel to each other.

Hosel 114 and/or hosel transition portion 115 can be located at or proximate to heel end 106, and hosel 114 can extend from club head 100 via hosel transition portion 115. Hosel 114 can be configured to receive a shaft (not shown). In a different embodiment, club head 100 can comprise a bore (not shown) configured to receive the shaft. Further, an opening of the bore can be substantially flush with crown surface 110. When hosel 114 (or the bore) receives the shaft, club head 100 and the shaft can substantially provide a golf club, as described above.

Weight port(s) 217 can alter the physical properties of club head 100, making one or more parameters of club head 100 adjustable (e.g., as desirable). Weight port(s) 217 can be configured to receive one or more weights (e.g., removable weights), though one or more of weight port(s) 217 can be left without a weight. When the weight(s) are removable, the weight(s) can be part of a set of weight(s) comprising different masses. Weight port(s) 217 can alter the physical properties of club head 100 based on the location(s) of weight port(s) 217 at club head 100 and/or the mass of the weight(s) received at weight port(s) 217. In some examples, weight port(s) 217 can be omitted, such as, for example, to lower manufacturing costs and/or complexity of operation of club head 100.

In many examples, weight port(s) 217 can alter the location of the center of gravity of club head 100. For example, the location of the center of gravity of club head 100 can be moved, as desired, toward any of top end 101, bottom end 102, front end 103, rear end 104, toe end 105, and heel end 106. Increasing the amount of mass in a direction of (e.g., toward) top end 101, bottom end 102, front end 103, rear end 104, toe end 105, and heel end 106 can also move the center of gravity in that direction. The location of the center of gravity can affect various performance characteristics of golf club 100, such as, for example, the launch angle and/or force applied to a golf ball upon impact with golf club 100.

Altering the location of the center of gravity of club head 100 can alter the moment of inertia of club head 100 about the center of gravity of club head 100 and/or about a shaft received at hostel 114. The moment of inertia of the center of gravity can affect various performance characteristics of golf club 100, such as, for example, the spin applied to a golf ball upon impact with golf club 100. Accordingly, weight port(s) 217 can also alter the moment of inertia of club head 100 about the center of gravity of club head 100 and/or about a shaft received at hostel 114.

Figure 3:
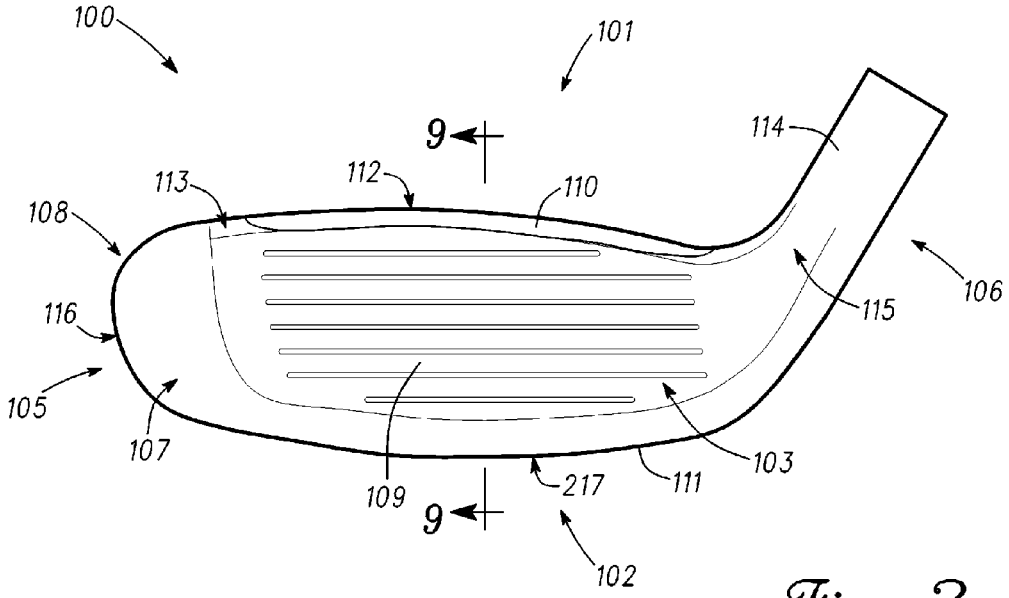
FIG. 3 illustrates a front view of the club head of the embodiment of FIG. 1.
Figure 4:
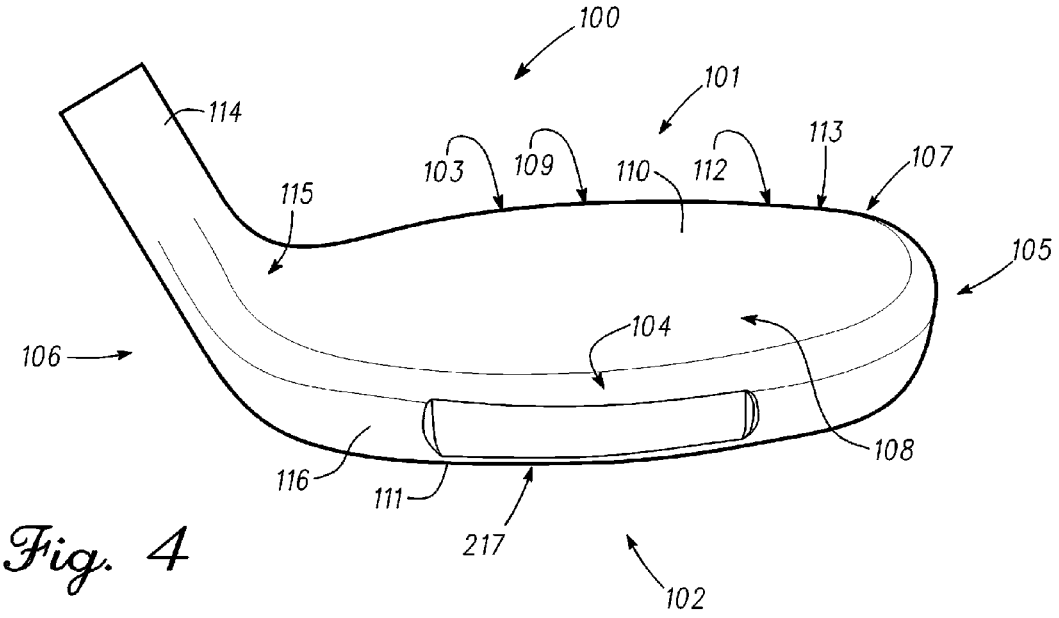
FIG. 4 illustrates a rear view of the club head of the embodiment of FIG. 1.
Figure 5:
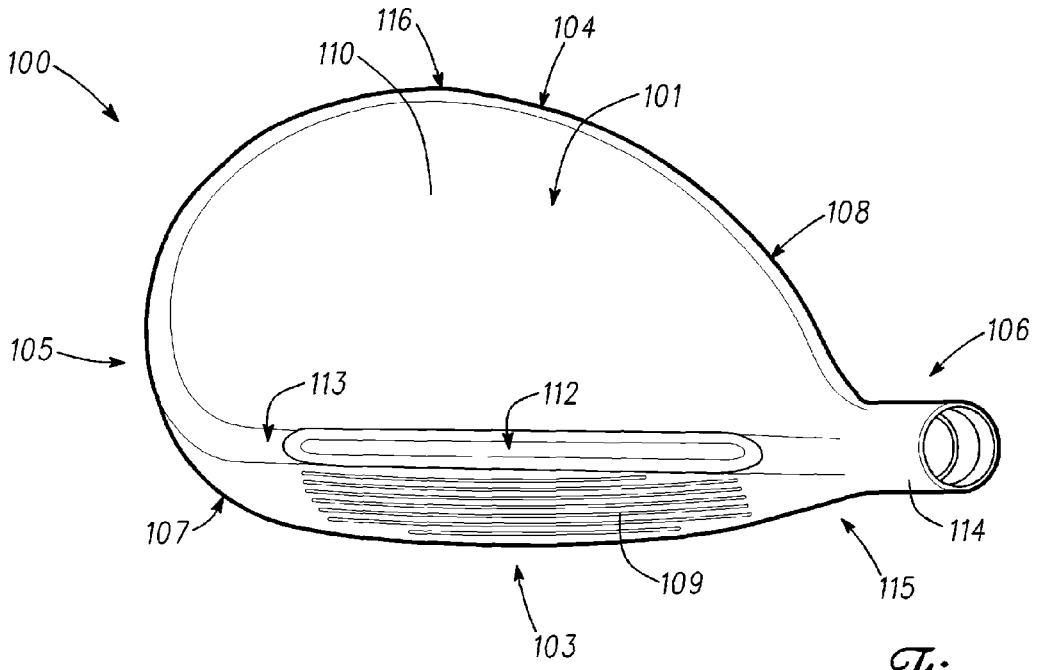
FIG. 5 illustrates a top view of the club head of the embodiment of FIG. 1.
Figure 6:
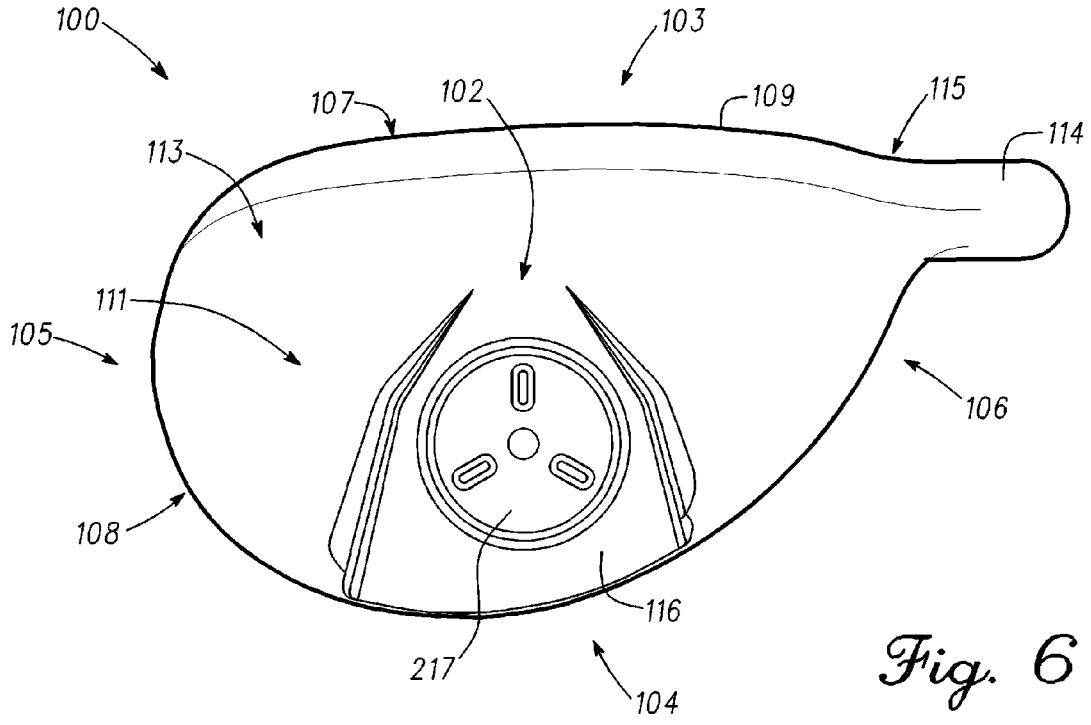
FIG. 6 illustrates a bottom view of the club head of the embodiment of FIG. 1.
Figure 7:
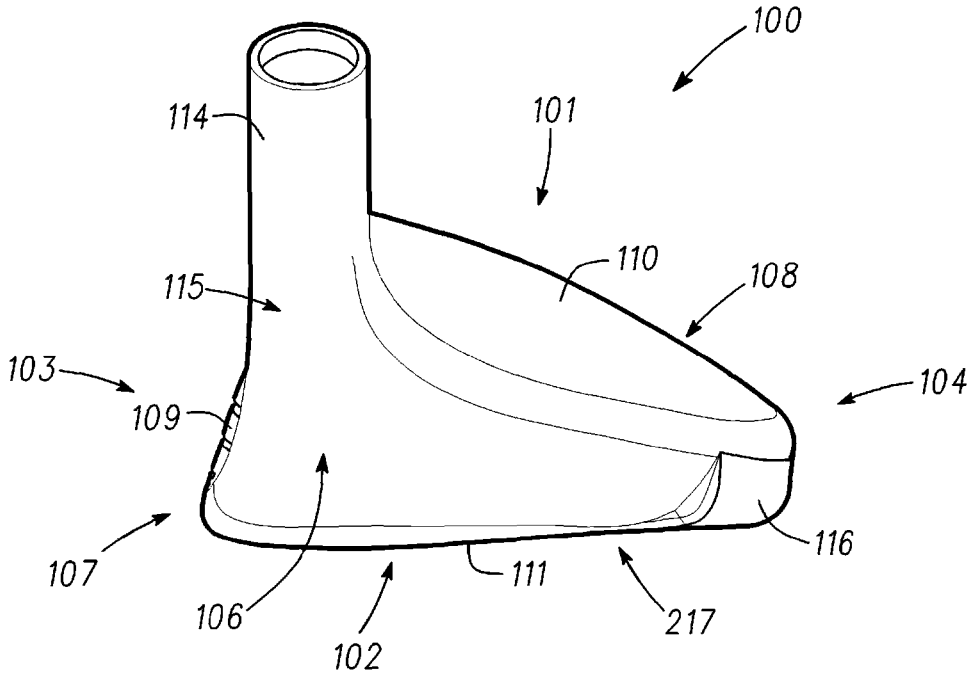
FIG. 7 illustrates a right side view of the club head of the embodiment of FIG. 1.
Figure 8:
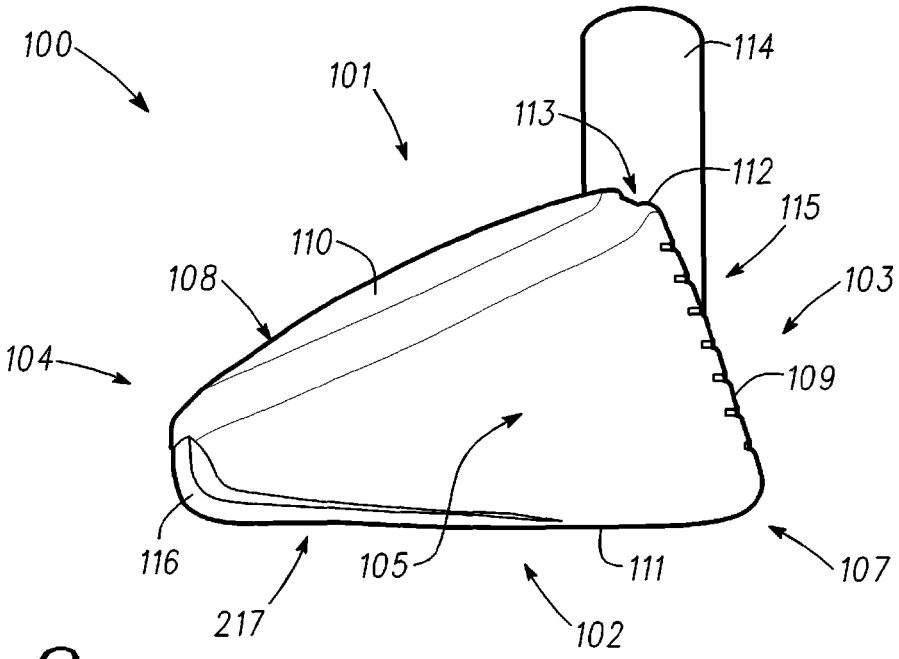
FIG. 8 illustrates a left side view of the club head of the embodiment of FIG. 1.

Turning ahead in the drawings, FIGS. 2-8 illustrate club head 100 from additional views, according to the embodiment of FIG. 1. Specifically, FIG. 2 illustrates a bottom, rear view of club head 100, according to the embodiment of FIG. 1, at which weight port(s) 217 are visible. Meanwhile, FIG. 3 illustrates a front view of club head 100; FIG. 4 illustrates a rear view of club head 100; FIG. 5 illustrates a top view of club head 100; FIG. 6 illustrates a bottom view of club head 100; FIG. 7 illustrates a right side view of club head 100; and FIG. 8 illustrates a left side view of club head 100. Although FIGS. 1-8 illustrate a particular exemplary embodiment of club head 100, club head 100 can comprise certain portions and/or surfaces not shown at FIGS. 1-8 and/or can omit certain portions and/or surfaces shown at FIGS. 1-8.

Figure 9:
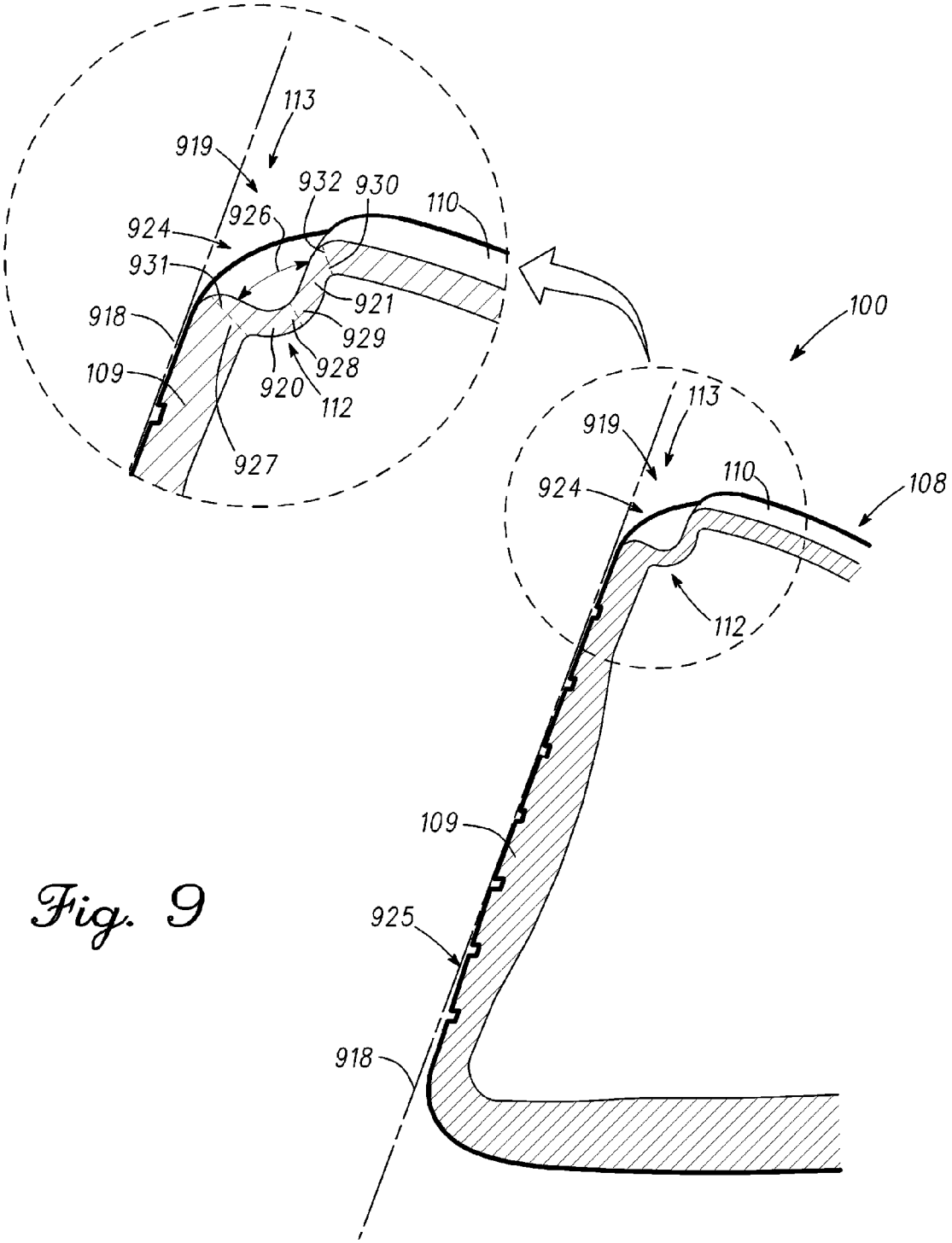
FIG. 9 illustrates a partial cross-sectional view of the club head of the embodiment of FIG. 1 along line 3-3 of FIG. 3 when the club head is in a resting state.

Turning ahead again in the drawings, FIG. 9 illustrates a partial cross-sectional view of club head 100 along line 3-3 of FIG. 3. More specifically, FIG. 9 shows deflection mechanism 112. Meanwhile, as further shown at FIG. 9, front surface 109 can be associated with face plane 918 and loft plane 925.

Deflection mechanism 112 comprises one or more deflection features 919. Deflection mechanism 112 can comprise one or more grooves 924. Deflection mechanism 112, deflection feature(s) 919, and/or groove(s) 924 can be located at (e.g. along) interface 113 (FIGS. 1-8) between one of: (i) front surface 109 and crown surface 110 or (ii) front surface 109 and sole surface 111 (FIGS. 1-8). Further, deflection feature(s) 919 can be located in groove(s) 924. In these examples, each of groove(s) 924 can comprise one or more of deflection feature(s) 919. In various embodiments, deflection mechanism 112 comprises only one groove comprising only one deflection feature.

Face plane 918 and loft plane 925 can refer to first and second reference planes of club head 100. Face plane 918 intersects the foremost point or points (e.g., nearest front end 103 (FIGS. 1-8) of front surface 109. Further, face plane 918 can be approximately parallel with front surface 109 when club head 100 is positioned to address a golf ball and when club head 100 is in a resting state (i.e., when front surface 109 is not deflected toward body portion 108). When front surface 109 is planar and/or substantially planar, front surface 109 and face plane 918 can be approximately co-planar. Meanwhile, when front surface 109 is curved (e.g., non-planar), as can frequently be implemented with wood-type club heads, face plane 918 can refer to a reference plane intersecting an inflection point in the curvature of front surface 109. Accordingly, at least part of front surface 109 can be located behind face plane 918. In general, face plane 918 and loft plane 925 are parallel and co-planar with each other when club head 100 is positioned to address the golf ball and when club head 100 is in the resting state. Loft plane 925 and face plane 918 can be distinguishable in that the orientation of the loft plane remains static whereas the orientation of face plane 918 changes according to a deflection of front surface 109. Accordingly, a relationship of the orientation of face plane 918 with respect to the orientation of loft plane 925 can aid in expressing the deflection of face plane 918. Under this convention, when face plane 918 is co-planar with loft plane 925, club head 100 can be in the resting stating, as described previously.

In many embodiments, deflection mechanism 112, deflection feature(s) 919, and/or groove 924 can be cast together with front portion 107 (FIGS. 1-8) and/or body portion 108. In other embodiments, deflection mechanism 112, deflection feature(s) 919, and/or groove 924 can be machined at interface 113 (FIGS. 1-8) of club head 100. Further still, deflection mechanism 112, deflection feature(s) 919, and/or groove 924 can be provided according to any suitable manufacturing techniques.

Meanwhile, deflection feature(s) 919 can be arranged according to any suitable geometry permitting front surface 109 to deflect: (a) toward body portion 108 at one of top end 101 or bottom end 102 (i.e., away from the loft plane of club head 100 at top end 101 (FIGS. 1-8) or bottom end 102 (FIGS. 1-8)), and (b) about (i.e., rotationally) the other one of top end 101 or bottom end 102. Operatively, deflection mechanism 112 and deflection feature(s) 919 can act as an elastic crumple zone located at interface 113 (i.e., along interface 113 (FIGS. 1-8) at either top end 101 (FIGS. 1-8) or bottom end 102 (FIGS. 1-8)) so that an impact of front surface 109 with an object (e.g., a golf ball) causes front surface 109 to deflect toward body portion 108 (i.e., away from the loft plane of club head 100 at top end 101 or bottom end 102) at deflection mechanism 112 and/or deflection feature(s) 919. Meanwhile, when deflection mechanism 112 crumples at deflection mechanism 112 and/or deflection feature(s) 919 upon contacting the object, front surface 109 can deflect about (i.e., rotationally) interface 113 the other one of top end 101 (FIGS. 1-8) or bottom end 102 (FIGS. 1-8) where deflection mechanism 112 and/or deflection feature(s) 919 is not located. Accordingly, front surface 109 can behave similarly to a cantilevered beam having a force applied at a free end of the beam and bending about a fixed end of the beam.

Accordingly, each of deflection feature(s) 919 can comprise a curve or a polygonal chain comprising two or more segments. For example, each of deflection feature(s) 919 can comprise two segments: a step portion and a riser portion (e.g., step portion 920 and riser portion 921, etc.). As a result, in these examples, deflection feature(s) 919 can resemble stairs. In specific examples, deflection feature(s) 919 can comprise deflection feature angle 926, and deflection feature (s) 919 can comprise step portion 920 and riser portion 921. Step portion 920 can comprise step portion first side 927 and step portion second side 928 opposite step portion first side 927. Further, riser portion 921 can comprise riser portion first side 929 and riser portion second side 930 opposite riser portion first side 929. Meanwhile, front surface 109 can comprise upper perimeter portion 931, and crown surface 110 can comprise fore perimeter portion 932. Step portion first side 927 can be adjacent to, transition into, and/or contact (e.g., be coupled with) upper perimeter portion 931; step portion second side 928 can be adjacent to, transition into, and/or contact (e.g., be coupled with) riser portion first side 929; and riser portion second side 930 can be adjacent to, transition into, and/or contact (e.g., be coupled with) fore perimeter portion 932. Points of adjacency, transitions, and/or points of contact between step portion first side 927 and upper perimeter portion 931, step portion second side 928 and riser portion first side 929, and riser portion second side 930 and fore perimeter portion 932 can be beveled or angled, as desired.

When club head 100 is in a resting state (e.g., face plane 918 is approximately co-planar with loft plane 925), the step portion(s) (e.g., step portion 920) of deflection feature(s) 919 can be approximately perpendicular to face plane 918, and/or the riser portion(s) (e.g., riser portion 921) of deflection feature(s) 919 can be approximately parallel to face plane 918. Arranged in this manner, when front surface 109 impacts a golf ball, the step portion(s) (e.g., step portion 920) can operate as load transfer beam(s) undergoing compression (e.g., pure compression), and/or the riser portion(s) (e.g., riser portion 921) can operate as deflection beam(s) undergoing bending (e.g., pure bending). Further, when club head 100 is in the resting state, each pair of step portion and riser portion of deflection feature(s) 919 can form a deflection feature angle (e.g., deflection feature angle 926). The deflection feature angle can be greater than approximately 0 degrees and less than approximately 180 degrees. In further embodiments, the deflection feature angle can be greater than or equal to approximately 80 degrees and less than or equal to approximately 100 degrees. In many examples, the deflection feature angle can be approximately 90 degrees.

Meanwhile, each step portion (e.g., step portion 920) of deflection feature(s) 919 can comprise a step portion length, and each riser portion (e.g., riser portion 921) of deflection feature(s) 919 can comprise a riser portion length. The step portion length can refer to a dimension of the step portion(s) extending approximately between front end 103 (FIGS. 1-8) and rear end 104 (FIGS. 1-8), and the riser portion length can refer to a dimension of the riser portion(s) extending approximately between top end 101 (FIGS. 1-8) and bottom end 102 (FIGS. 1-8). In many examples, the step portion length(s) and/or the riser portion length(s) can be greater than or equal to approximately 2.540 centimeters and less than or equal to approximately 10.16 centimeters. The step portion length(s) and riser portion length(s) can be equal or different to each other. As the step portion length(s) increase, the step portion (s) can be more likely to buckle when front surface 109 impacts a golf ball. Meanwhile, as the rise length(s) increase, the riser portion(s) can undergo increased bending, but also can further decrease a height of front surface 109 unless compensation to front surface 109 is implemented.

Further still, each step portion (e.g., step portion 920) of deflection feature(s) 919 can comprise a step portion thickness, and each riser portion (e.g., riser portion 921) of deflection feature(s) 919 can comprise a riser portion thickness. The riser portion thickness can refer to a dimension of the riser portion(s) extending approximately between front end 103 (FIGS. 1-8) and rear end 104 (FIGS. 1-8), and the step portion thickness can refer to a dimension of the step portion(s) extending approximately between top end 101 (FIGS. 1-8) and bottom end 102 (FIGS. 1-8). The step portion thickness (es) and riser portion thickness(es) can be equal or different to each other. In many examples, the step portion thickness(es) and/or the riser portion thickness(es) can be greater than or equal to approximately 0.06 centimeters and less than or equal to approximately 0.18 centimeters.

In general, when deflection feature(s) 919 comprise multiple deflection features, the deflection feature angles, the step portion lengths, the riser portion lengths, the step portion thicknesses, and/or the riser portion thicknesses can be the same or different between one or more of the multiple deflection features. Further, deflection feature(s) 919 can comprise same or different materials from front portion 107 (FIGS. 1-8) and/or body portion 108.

By altering the ratio of upper to lower deflection of front surface 109, deflection mechanism 112 can be configured to dynamically alter a launch angle of a golf ball and/or dynamically alter a back spin of a golf ball as a function of a velocity of club head 100 upon impacting the golf ball. That is, a force applied to front surface 109 by the golf ball can be a function of the velocity of club head 100 upon impacting the golf ball. Accordingly, a deflected launch angle of the golf ball can be higher than a static launch angle of the golf ball, and/or a deflected back spin of the golf ball can be less than a static back spin of the golf ball. The deflected launch angle and deflected back spin can refer to a launch angle and a back spin when deflection mechanism 112 is implemented versus a static launch angle and a static back spin, which can refer to a launch angle and a back spin when deflection mechanism 112 is absent. The extent to which the launch angle increases and/or the back spin decreases can depend on how much force transfers to front surface 109 (i.e., how far deflection mechanism 112 deflects toward body portion 108). Greater force can result in greater increases in launch angle and greater decreases in back spin. In many examples, increasing the launch angle and/or decreasing the back spin on a golf ball can increase the flight distance of the golf ball. The increased launch angle can result from an increased loft angle of front surface 109 as front surface 109 deflects toward body portion 108. Meanwhile, the decreased back spin can result from an increased topspin gearing effect applied to the golf ball by front surface 109 as front surface 109 deflects toward body portion 108. In many examples, launch angle can be increased by greater than approximately 0 degrees and less than or equal to approximately 2 degrees. Further, back spin can be decreased by greater than approximately 0 rotations per minute and less than or equal to approximately 500 rotations per minute.

In some embodiments, the effects of deflection mechanism 112 can be paired with the effects of weight port(s) 217 to more specifically tailor the performance characteristics of club head 100. For example, in some embodiments, implementing weight port(s) 217 with deflection mechanism 112 can permit the launch angle and/or spin of the golf ball to be altered to a greater extent than would be possible with deflection mechanism 112. In further embodiments, weight port(s) 217 can permit fine tuning of the launch angle and/or spin of the golf ball.

In many examples, when deflection mechanism 112 is located at top end 101 (FIGS. 1-10), deflection mechanism 112 can dynamically increase a launch angle and dynamically decrease a backspin of a golf ball. Meanwhile, when deflection mechanism 112 is located at bottom end 102 (not shown), deflection mechanism 112 can dynamically decrease the launch angle and the backspin of the golf ball. However, in these examples, deflection mechanism 112 can be configured such that the decrease in backspin compensates for decreases in launch angle so that increased flight distance is still achieved.

Meanwhile, by locating deflection mechanism 112 at interface 113 (FIGS. 1-8), deflection mechanism 112 can be less distracting to a user of club head 100 if deflection mechanism 112 were located elsewhere at club head 100. Accordingly, in many examples, club head 100 and/or crown surface 110 can be devoid of other mechanisms configured to alter deflection of front surface 109 in order to mitigate distraction of the user. Further, deflection mechanism 112 can be configured to blend in with the scoring lines at front surface 109. Further still, by locating deflection mechanism 112 at interface 113 (FIGS. 1-8) (i.e., near front surface 109), deflection mechanism 112 can be more discrete (e.g., groove(s) 924 can be less deep).

Figure 10:
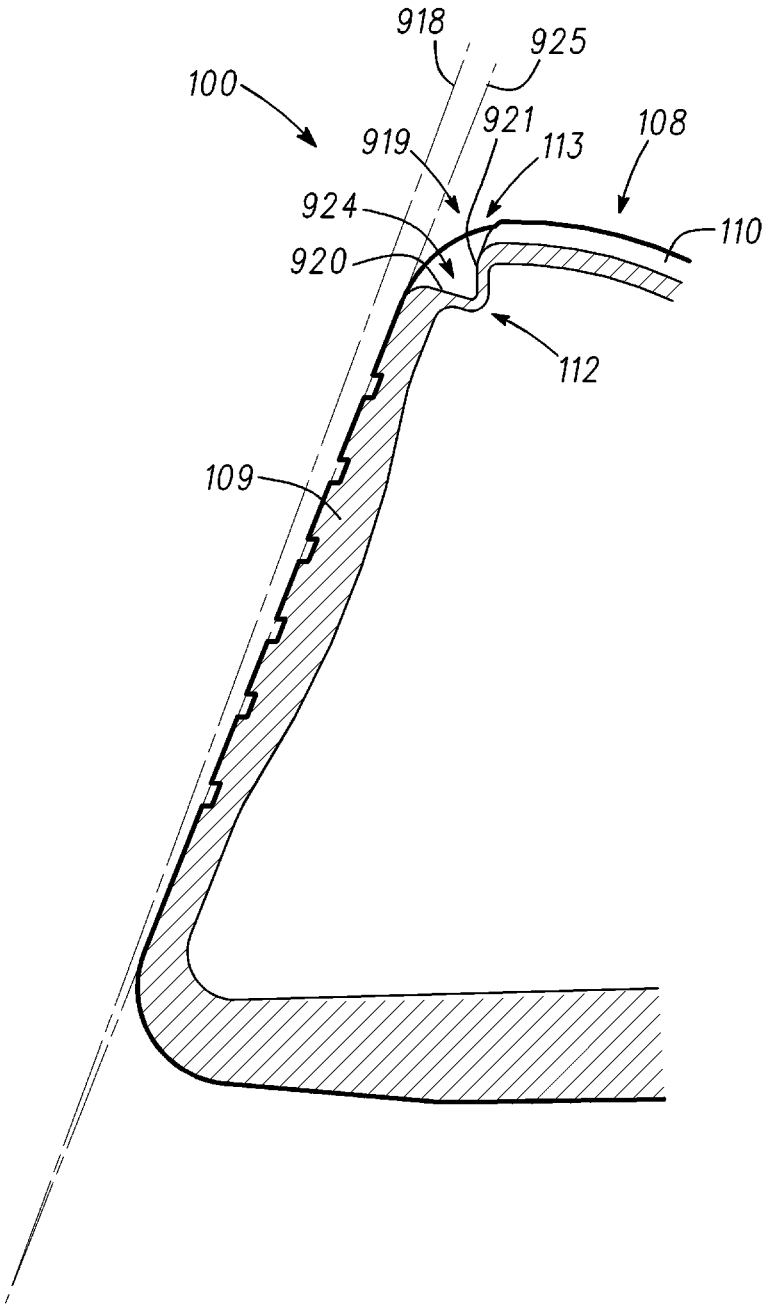
FIG. 10 illustrates a partial cross-sectional view of the club head of the embodiment of FIG. 1 along line 3-3 of FIG. 3 when a front surface of the club head is deflected.
Figure 11:
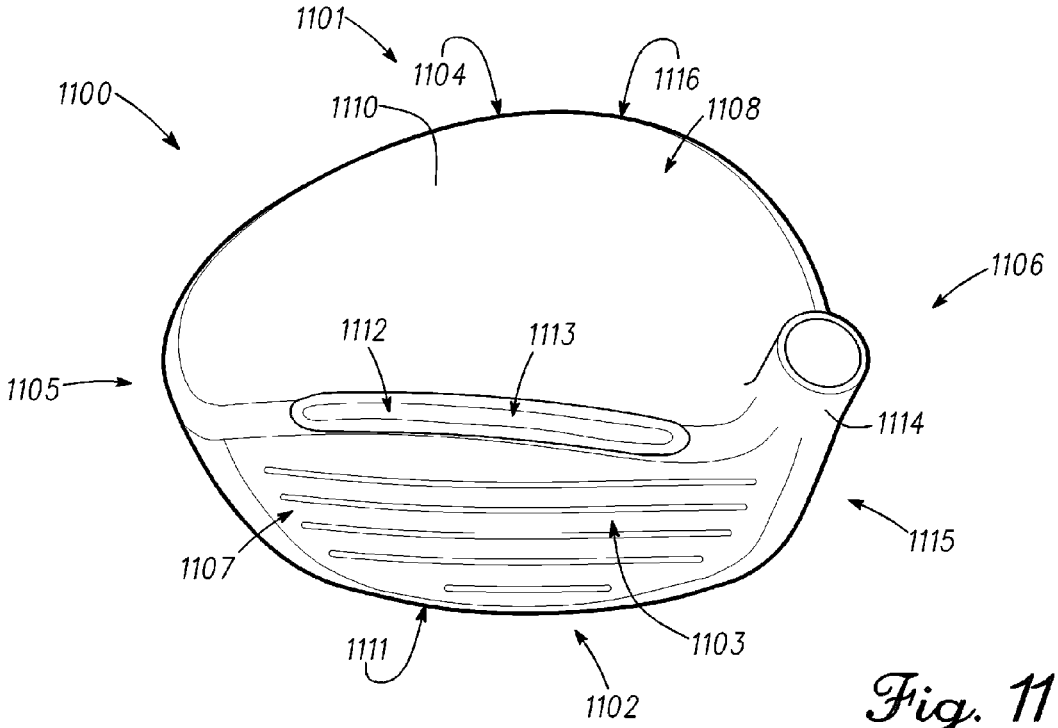
FIG. 11 illustrates a top view of an exemplary club head, according to another embodiment.
Figure 12:
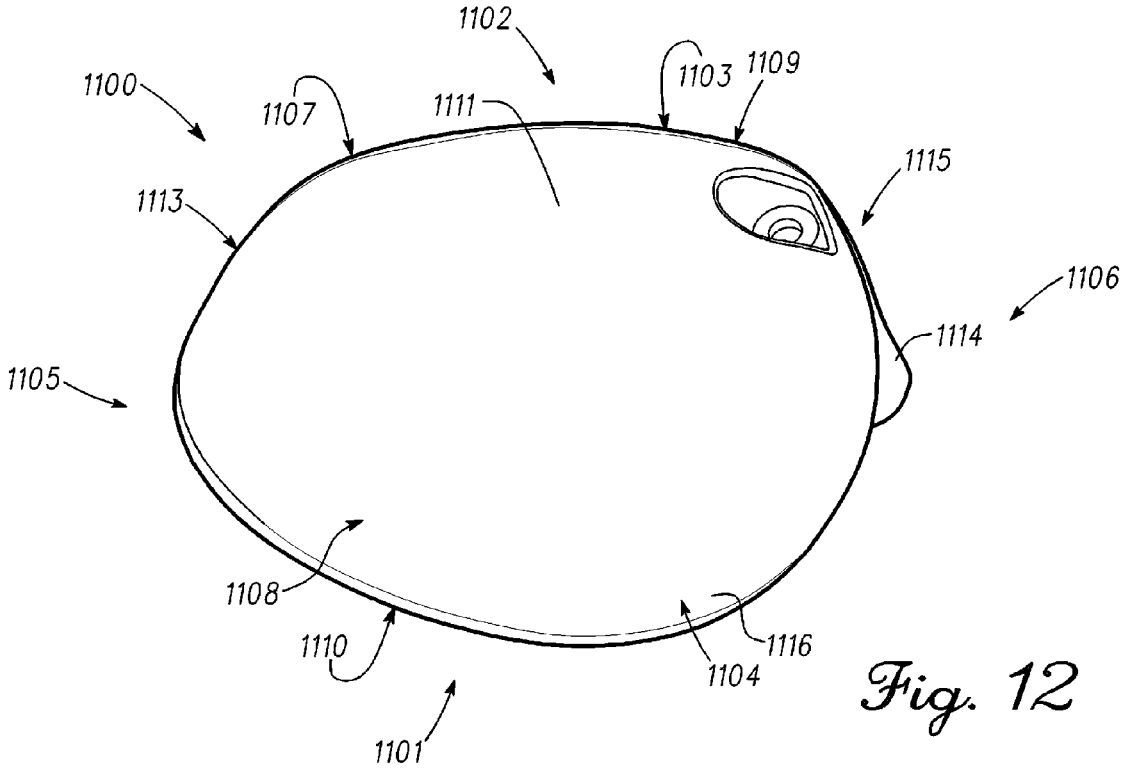
FIG. 12 illustrates a bottom, rear view of the club head of the embodiment of FIG. 11.
Figure 13:
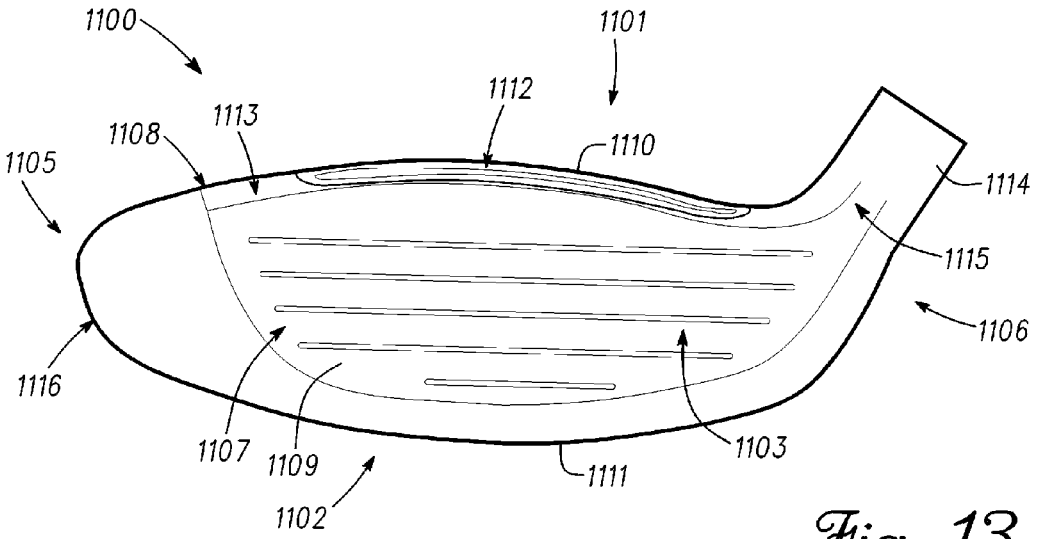
FIG. 13 illustrates a front view of the club head of the embodiment of FIG. 11.
Figure 14:
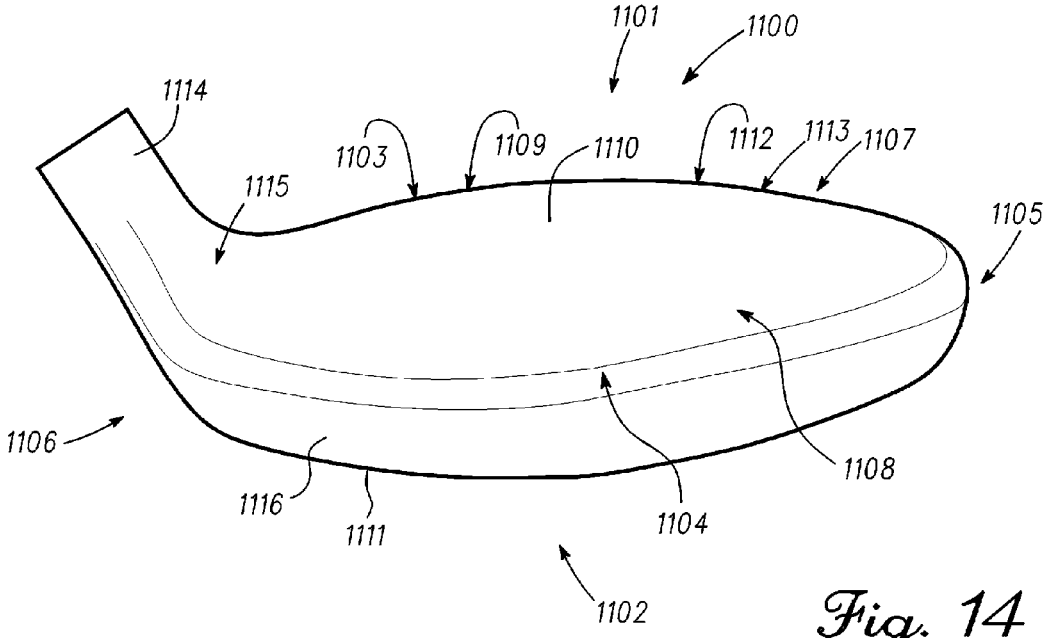
FIG. 14 illustrates a rear view of the club head of the embodiment of FIG. 11.
Figure 15:
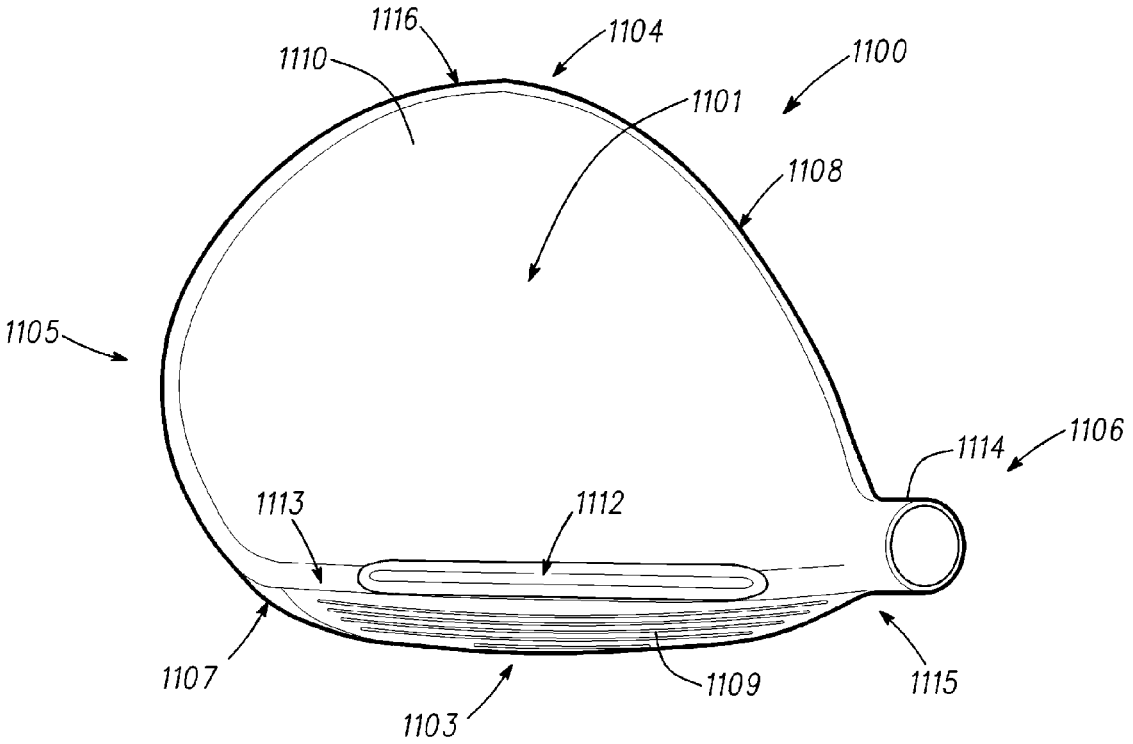
FIG. 15 illustrates a top view of the club head of the embodiment of FIG. 11.
Figure 16:
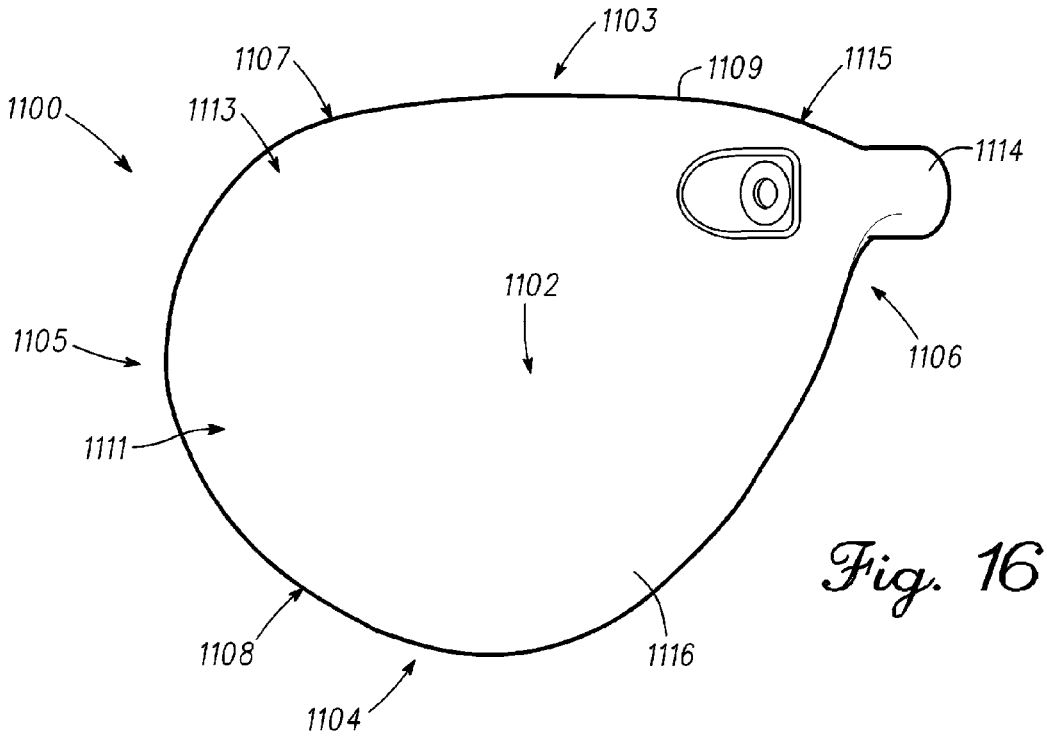
FIG. 16 illustrates a bottom view of the club head of the embodiment of FIG. 11.
Figure 17:
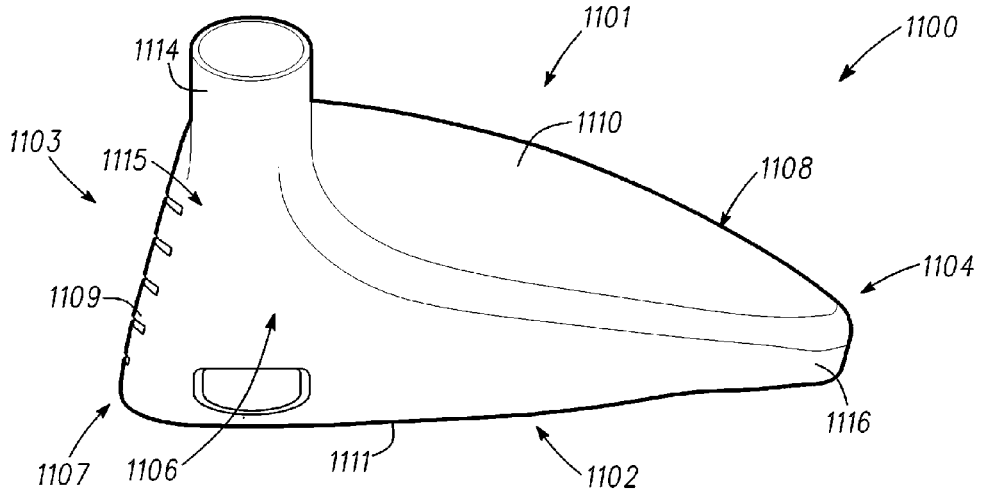
FIG. 17 illustrates a right side view of the club head of the embodiment of FIG. 11.
Figure 18:
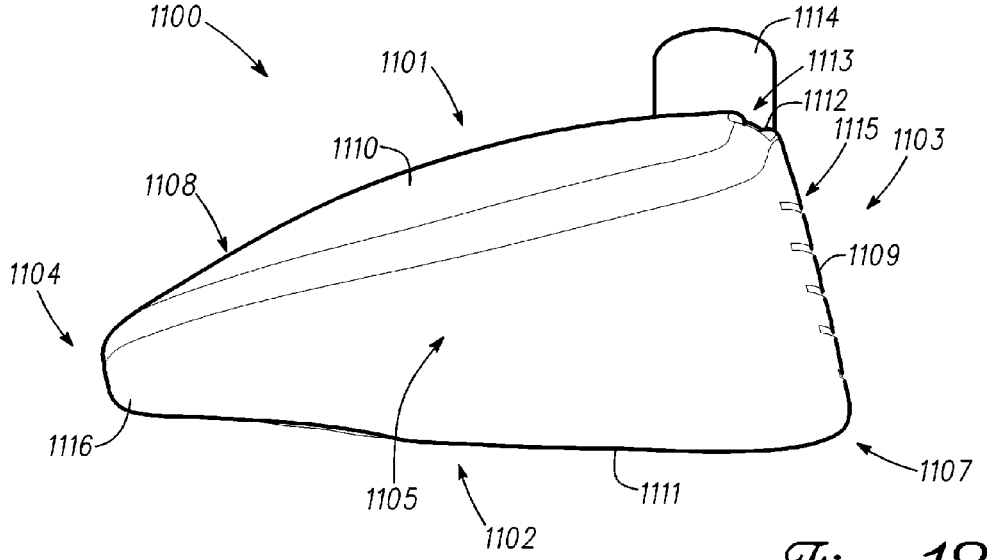
FIG. 18 illustrates a left side view of the club head of the embodiment of FIG. 11.

Turning ahead again in the drawings, FIG. 10 illustrates a partial cross-sectional view of club head 100 along line 3-3 of FIG. 3 when front surface 109 is deflected toward body portion 108. Accordingly, face plane 918 is not co-planar with loft plane 925.

Turning to the next drawings, FIGS. 11-18 illustrate various views of club head 1100, according to another embodiment. Club head 1100 can be similar to club head 100 (FIGS. 1-10), but can be devoid of weight port(s). Accordingly, where elements of club head 1100 are referenced with numbers having the same last two digits as the reference numbers of club head 100 (FIGS. 1-10), the elements can be similar or identical to those of club head 100. As a result, in some embodiments, club head 1100 can be less expensive to manufacture and/or less complex to operate than club head 100 (FIGS. 1-10).

Figure 19:
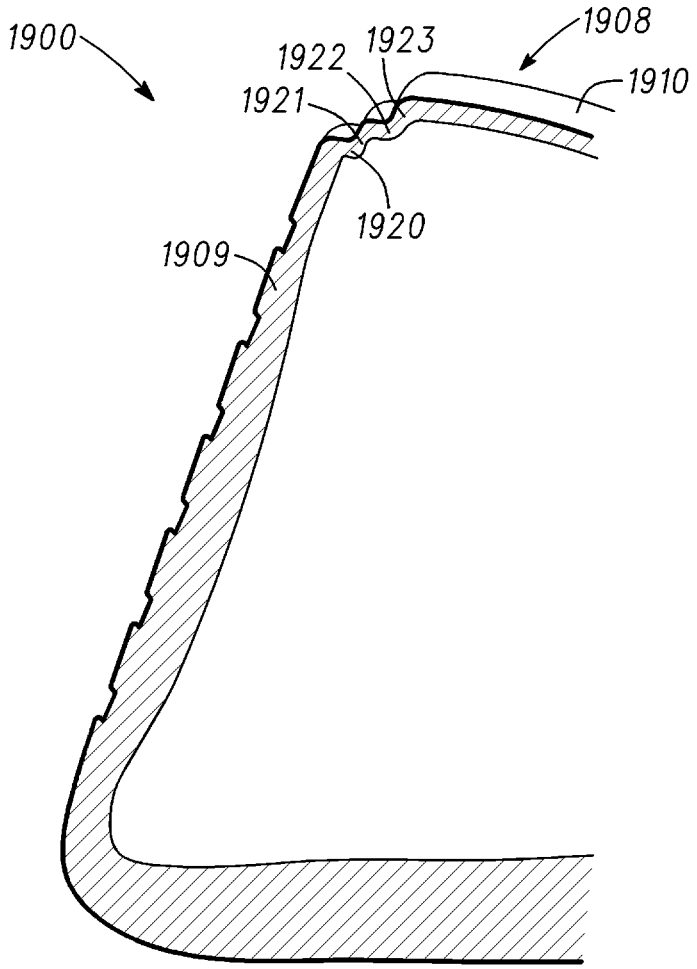
FIG. 19 illustrates a partial cross-sectional view of a club head, according to another embodiment.

Further, FIG. 19 illustrates a partial cross-sectional view of club head 1900. Club head 1900 can be similar to club head 100 (FIGS. 1-10) and club head 1100 (FIGS. 11-18) Accordingly, where elements of club head 1900 are referenced with numbers having the same last two digits as the reference numbers of club head 100 (FIGS. 1-10) and club head 1100 (FIGS. 11-18), the elements can be similar or identical to those of club head 100 and club head 1100. Further still, club head 1900 comprises deflection mechanism 1912, deflection mechanism comprises step portion 1920, riser portion 1921, step portion 1922, and riser portion 1923. Step portion 1920 and step portion 1922 can each be similar or identical to step portion 920 (FIG. 9), and riser portion 1921 and riser portion 1923 can each be similar or identical to riser portion 921 (FIG. 9).

In many embodiments, any of club head 100 (FIGS. 1-10), club head 1100 (FIGS. 11-18), and/or club head 1900 (FIG. 19) can comprise one or more branding and/or other symbols, such as, for example, to indicate a manufacturer of club head 100, club head 1100, and/or club head 1900, respectively.

Figure 20:
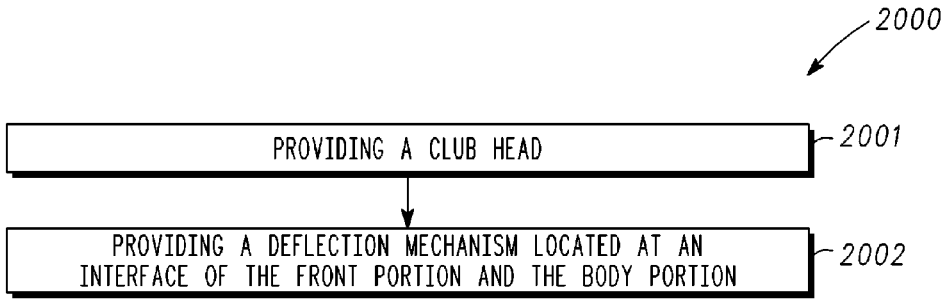
FIG. 20 illustrates a flow chart for an embodiment of a method.

Turning to the next drawing, FIG. 20 illustrates a flow chart for an embodiment of method 2000. Method 2000 is merely exemplary and is not limited to the embodiments presented herein. Method 2000 can be employed in many different embodiments or examples not specifically depicted or described herein. In some embodiments, the procedures, the processes, and/or the activities of method 2000 can be performed in the order presented. In other embodiments, the procedures, the processes, and/or the activities of the method 2000 can be performed in any other suitable order. In still other embodiments, one or more of the procedures, the processes, and/or the activities in method 2000 can be combined or skipped.

Method 2000 can comprise activity 2001 of providing a club head. The club head can be similar or identical to club head 100 (FIGS. 1-10), club head 1100 (FIGS. 11-18), and/or club head 1900 (FIG. 19). For example, the club head can comprise a top end and a bottom end opposite the top end. Also, the club head can comprise a front portion comprising a front surface, and can comprise a body portion comprising a crown surface and a sole surface. The top end can be similar or identical to top end 101 (FIGS. 1-8) and/or top end 1101 (FIGS. 11-18), and the bottom end can be similar or identical to bottom end 102 (FIGS. 1-8) and/or bottom end 1102 (FIGS. 11-18). Further, the front portion can be similar or identical to front portion 107 (FIGS. 1-8) and/or front portion 1107 (FIGS. 11-18), the front surface can be similar or identical to front surface 109 (FIGS. 1-10), front surface 1109 (FIGS. 11-18), and/or front surface 1909 (FIG. 19), the body portion can be similar or identical to body portion 108 (FIGS. 1-8), body portion 1108 (FIGS. 11-18), and/or body portion 1908 (FIG. 19), the crown surface can be similar or identical to crown surface 110 (FIGS. 1-10), crown surface 1110 (FIGS. 11-18), and/or crown surface 1910 (FIG. 19), and/or the sole surface can be similar or identical to sole surface 111 (FIGS. 1-8) and/or sole surface 1111 (FIGS. 11-18).

Figure 21:
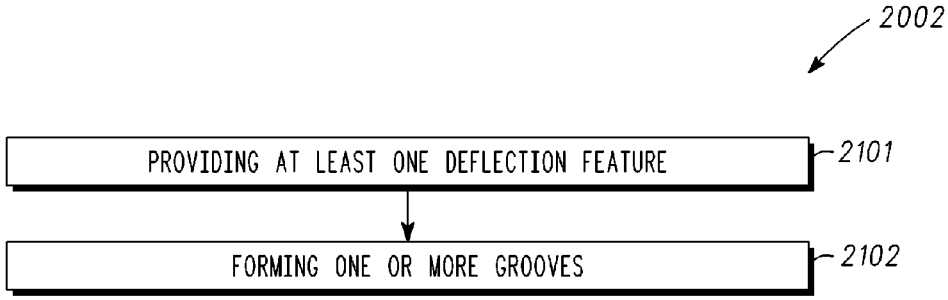
FIG. 21 illustrates an exemplary activity of providing a deflection mechanism located at an interface of a front portion and a body portion of a club head, according to the embodiment of FIG. 20.

Method 2000 can comprise activity 2002 of providing a deflection mechanism located at an interface of the front portion and the body portion. The deflection mechanism can be similar or identical to deflection mechanism 112 (FIGS. 1-10), deflection mechanism 1112 (FIGS. 11-18), and/or deflection mechanism 1912 (FIG. 19). Further, the interface can be similar or identical to interface 113 (FIGS. 1-8) and/or interface 1113 (FIGS. 11-18). In some embodiments, activity 2002 can be performed as part of activity 2001, and/or can be performed approximately simultaneously with activity 2001. In many examples, performing activity 2001 can comprise casting the deflection mechanism together with the club head. In other examples, performing activity 2001 can comprise machining the deflection mechanism into the club head. FIG. 21 illustrates an exemplary activity 2002, according to the embodiment of FIG. 20.

Referring to FIG. 21, activity 2002 can comprise activity 2101 of providing at least one deflection feature. The deflection feature(s) can be similar or identical to deflection feature (s) 919 (FIGS. 9 & 10). For example, each deflection feature can comprise a step portion and a riser portion. Each of the step portion(s) can be similar or identical to step portion 920 (FIGS. 9 & 10), step portion 1920 (FIG. 19), and/or step portion 1922 (FIG. 19), and each of the riser portion(s) can be similar or identical to riser portion 921 (FIGS. 9 & 10), riser portion 1921 (FIG. 19), and/or riser portion 1923 (FIG. 19). Further, providing the deflection feature(s) can comprise providing the step portion and the riser portion of each deflection feature to form a deflection feature angle when a face plane associated with the front surface is approximately co-planar with a loft plane associated with the front surface. The deflection feature angle can be similar or identical to deflection feature angle 926 (FIG. 9). Further, the face plane can be similar or identical to face plane 918 (FIGS. 9 & 10), and/or the loft plane can be similar or identical to loft plane 925 (FIGS. 9 & 10).

Further, activity 2001 can comprise activity 2102 of forming one or more grooves. The groove(s) can be similar or identical to groove(s) 924 (FIGS. 9 & 10). In some embodiments, activity 2101 and activity 2102 can be performed approximately simultaneously with each other. In other embodiments, activity 2102 can be omitted.

Figure 22:
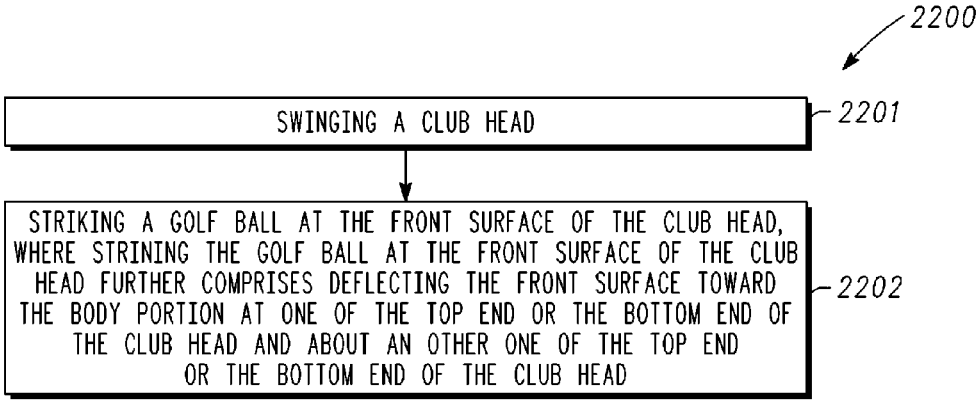
FIG. 22 illustrates a flow chart for another embodiment of a method.

Turning to the next drawing, FIG. 22 illustrates a flow chart for an embodiment of method 2200. Method 2200 is merely exemplary and is not limited to the embodiments presented herein. Method 2200 can be employed in many different embodiments or examples not specifically depicted or described herein. In some embodiments, the procedures, the processes, and/or the activities of method 2200 can be performed in the order presented. In other embodiments, the procedures, the processes, and/or the activities of the method 2200 can be performed in any other suitable order. In still other embodiments, one or more of the procedures, the processes, and/or the activities in method 2200 can be combined or skipped.

Method 2200 can comprise activity 2201 of swinging a club head. The club head can be similar or identical to club head 100 (FIGS. 1-10), club head 1100 (FIGS. 11-18), and/or club head 1900 (FIG. 19). For example, the club head can comprise a top end and a bottom end opposite the top end. Also, the club head can comprise a front portion comprising a front surface, and can comprise a body portion comprising a crown surface and a sole surface. The top end can be similar or identical to top end 101 (FIGS. 1-8) and/or top end 1101 (FIGS. 11-18), and the bottom end can be similar or identical to bottom end 102 (FIGS. 1-8) and/or bottom end 1102 (FIGS. 11-18). Further, the front portion can be similar or identical to front portion 107 (FIGS. 1-8) and/or front portion 1107 (FIGS. 11-18), the front surface can be similar or identical to front surface 109 (FIGS. 1-10), front surface 1109 (FIGS. 11-18), and/or front surface 1909 (FIG. 19), the body portion can be similar or identical to body portion 108 (FIGS. 1-8), body portion 1108 (FIGS. 11-18), and/or body portion 1908 (FIG. 19), the crown surface can be similar or identical to crown surface 110 (FIGS. 1-10), crown surface 1110 (FIGS. 11-18), and/or crown surface 1910 (FIG. 19), and/or the sole surface can be similar or identical to sole surface 111 (FIGS. 1-8) and/or sole surface 1111 (FIGS. 11-18).

Method 2200 can comprise activity 2202 of striking a golf ball at the front surface of the club head, where striking the golf ball at the front surface of the club head further comprises deflecting the front surface toward the body portion at one of the top end or the bottom end of the club head and about an other one of the top end or the bottom end of the club head. In many examples, deflecting the front surface toward the body portion at one of the top end or the bottom end of the club head and about an other one of the top end or the bottom end of the club head can comprise (a) increasing a launch angle of the golf ball from the front surface, and/or (b) decreasing a back spin applied to the golf ball.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that activities 2001 and 2002 of FIG. 20, activities 2101 and 2102 of FIG. 21, and/or activities 2201 and 2202 of FIG. 20 may be comprised of many different procedures, processes, and activities and be performed by many different modules, in many different orders, that any element of FIGS. 1-19 may be modified, and that the foregoing discussion of certain of these embodiments does not necessarily represent a complete description of all possible embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club head, the apparatus, methods, and articles of manufacture described herein may be applicable to other types of golf clubs such as an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A club head comprising:

a top end and a bottom end opposite the top end;

a front portion comprising a front surface associated with a face plane and a loft plane, the front surface including an upper perimeter portion;

a body portion comprising a crown surface including a fore perimeter portion and a sole surface; and a deflection mechanism located at an interface of the front portion and the body portion, the deflection mechanism being configured so that the front surface is able to deflect toward the body portion at the top end and about the bottom end of the club head;

wherein:

the deflection mechanism comprises a groove located between the front surface and the crown surface;

the deflection mechanism comprises at least one deflection feature that is located in the groove, the at least one deflection feature comprising a step portion and a riser portion;

the step portion comprises a step portion first side and a step portion second side opposite the step portion first side, the step portion first side being adjacent to the upper perimeter portion;

the riser portion comprises a riser portion first side and a riser portion second side opposite the riser portion first side, the riser portion second side being adjacent to the fore perimeter portion, and the step portion second side being adjacent to the riser portion first side.

2. The club head of claim 1 wherein:

when the face plane is approximately co-planar with the loft plane, at least one of:

the step portion of the at least one deflection feature is approximately perpendicular to the face plane; or the riser portion of the at least one deflection feature is approximately parallel to the face plane.

3. The club head of claim 1 wherein:

when the face plane is approximately co-planar with the loft plane, the step portion and the riser portion of the at least one deflection feature form a deflection feature angle greater than approximately 0 degrees and less than approximately 180 degrees.

4. The club head of claim 1 wherein:

the step portion of the at least one deflection feature comprises a step portion length;

the riser portion of the at least one deflection feature comprises a riser portion length; and the step portion length and the riser portion length are approximately equal.

5. The club head of claim 1 wherein:

the step portion of the at least one deflection feature comprises a step portion thickness;

the riser portion of the at least one deflection feature comprises a riser portion thickness; and at least one of the step portion thickness or the riser portion thickness are greater than or equal to approximately 0.06 centimeter and less than or equal to approximately 0.18 centimeter.

6. The club head of claim 1 wherein:

when the front surface strikes a golf ball such that the deflection mechanism deflects toward the body portion at the one of the top end or the bottom end of the club head and about the other one of the top end or the bottom end of the club head, at least one of: (i) a deflected launch angle of the golf ball is higher than a static launch angle of the golf ball or (ii) a deflected back spin of the golf ball is less than a static back spin of the golf ball.

7. The club head of claim 1 wherein:

the club head comprises one of a driver club head, a fairway wood club head, or a hybrid golf club head.

8. The club head of claim 1 wherein:

when the face plane is approximately co-planar with the loft plane, the step portion of the each deflection feature of the at least one deflection feature is approximately perpendicular to the face plane, and the riser portion of the at least one deflection feature is approximately parallel to the face plane.

9. A method comprising:

providing a club head comprising:

a top end and a bottom end opposite the top end;

a front portion comprising a front surface associated with a face plane and a loft plane, the front surface including an upper perimeter portion; and a body portion comprising a crown surface including a fore perimeter portion and a sole surface;

providing a deflection mechanism located at an interface of the front portion and the body portion, the deflection mechanism being configured so that the front surface is able to deflect toward the body portion at the top end and about the bottom end of the club head;

wherein:

providing the deflection mechanism comprises providing at least one deflection feature, the at least one deflection feature comprising a step portion and a riser portion, the step portion comprising a step portion first side that is adjacent to the upper perimeter portion the riser portion comprising a riser portion first side and a riser portion second side opposite the riser portion first side and adjacent to the fore perimeter portion, and a step portion second side opposite the step portion first side and adjacent to the riser portion first side;

providing the deflection mechanism comprises forming one or more grooves comprising the at least one deflection feature such that the one or more grooves are located between the front surface and the crown surface.

10. The method of claim 9 wherein:

providing the at least one deflection feature comprises providing the step portion and the riser portion of the at least one deflection feature to form a deflection feature angle when the face plane is approximately co-planar with the loft plane, the deflection feature angle being greater than approximately 0 degrees and less than approximately 180 degrees.

11. The method of claim 9 wherein:

providing the deflection mechanism comprises providing the step portion having a step portion length and the riser portion having a riser portion length, wherein the step portion length and the riser portion length are approximately equal.

12. The method of claim 9 wherein:

providing the deflection mechanism comprises providing the step portion having a step portion thickness and the riser portion having a riser portion thickness, wherein at least one of the step portion thickness or the riser portion thickness are greater than or equal to approximately 0.06 centimeter and less than or equal to approximately 0.18 centimeter.

13. The method of claim 9 wherein:

providing the club head comprises providing one of a driver club head, a fairway wood club head, or a hybrid golf club head.

14. A golf club comprising:

a club head comprising:

a top end and a bottom end opposite the top end;

a front portion comprising a front surface comprising an upper perimeter portion;

a body portion comprising a crown surface including a fore perimeter portion and a sole surface; and a deflection mechanism located at an interface of the front portion and the body portion; and a club shaft coupled to the club head;

wherein:

the deflection mechanism is configured such that striking a golf ball at the front surface of the club head causes the front surface to deflect toward the body portion of the top end and about the bottom end of the club head;

the deflection mechanism comprises a groove located between the front surface and the crown surface;

the deflection mechanism comprises at least one deflection feature that is located in the groove, the at least one deflection feature comprising a step portion and a riser portion;

the step portion comprises a step portion first side and a step portion second side opposite the step portion first side, the step portion first side being adjacent to the upper perimeter portion;

the riser portion comprises a riser portion first side and a riser portion second side opposite the riser portion first side, the riser portion second side being adjacent to the fore perimeter portion, and the step portion second side being adjacent to the riser portion first side.

15. The golf club of claim 14 wherein:

the deflection mechanism is configured to at least one of (i) increase a launch angle of the golf ball from the front surface or (ii) decrease a back spin applied to the golf ball when or after the golf ball strikes the front surface of the club head and causes the front surface to deflect toward the body portion at the one of the top end or the bottom end of the club head and about the other one of the top end or the bottom end of the club head.

* * * * *